United States Patent [19]

Borisoff et al.

[11] Patent Number: 4,928,564

[45] Date of Patent: May 29, 1990

[54] APPARATUS AND METHOD FOR STABILIZING A TREMOLO ON A MUSICAL INSTRUMENT SUCH AS A GUITAR

[76] Inventors: David J. Borisoff, 22119 Victory Blvd., Canoga Park, Calif. 91303; Boris Borisoff, 5403 Blanco Ave., Woodland Hills, Calif. 91367

[21] Appl. No.: 234,886

[22] Filed: Aug. 22, 1988

[51] Int. Cl.[5] ..... G10D 3/12

[52] U.S. Cl. ..... 84/313

[58] Field of Search ..... 84/313

[56] References Cited

U.S. PATENT DOCUMENTS

| | | | |
|---|---|---|---|
| 3,241,418 | 3/1966 | Fender | 84/313 |
| 3,326,072 | 6/1967 | Price | 84/313 |
| 4,656,916 | 4/1987 | Gressett | 84/313 |
| 4,823,669 | 4/1989 | Sarricola | 84/313 |

FOREIGN PATENT DOCUMENTS

| | | | |
|---|---|---|---|
| 2587528 | 3/1987 | France | 84/313 |

*Primary Examiner*—Lawrence R. Franklin

*Attorney, Agent, or Firm*—Poms, Smith, Lande & Rose

[57] ABSTRACT

An apparatus and method of fine tuning an electric guitar having a plurality of guitar strings, a tremolo system including a bridge plate assembly having a pivotal connection to the guitar body and connected to each of said guitar strings, a tremolo arm connected to said bridge assembly for movement thereof about said pivotal connection, a bridge lever arm or sustain block on said bridge assembly extending into a cavity on the bottom face of said guitar and counterbalance springs connected to said guitar body in said cavity and connected to said lever arm of the bridge assembly and a tremolo control and stabilizer connected at one end to said guitar body and at the other end to said bridge plate assembly lever arm, said stabilizer including a composite spring means under compression and an adjustable nut for varying the compression of the composite spring. A method of stabilizing a neutral position of a tremolo system including a pivoted bridge assembly including the steps of tensioning all of the strings of a guitar to a selected pitch slightly less than a desired pitch, tensioning certain counter-balance springs connected between said bridge assembly and the guitar body to oppose the string tension, and mechanically adjusting a certain counter-balance spring to bring the tension in the guitar strings to a desired pitch whereby said mechanical adjustment provides a mechanical stop for returning all of the guitar strings to a selected pretuned pitch.

8 Claims, 4 Drawing Sheets

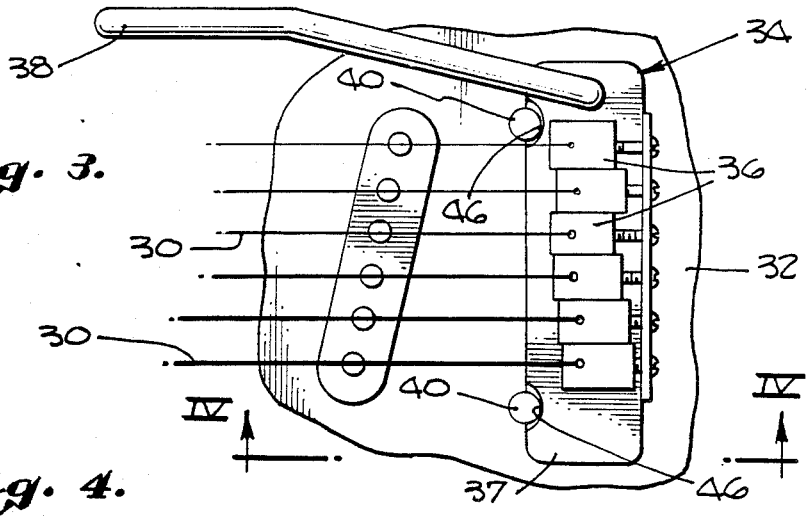
Fig. 3.
Fig. 4.
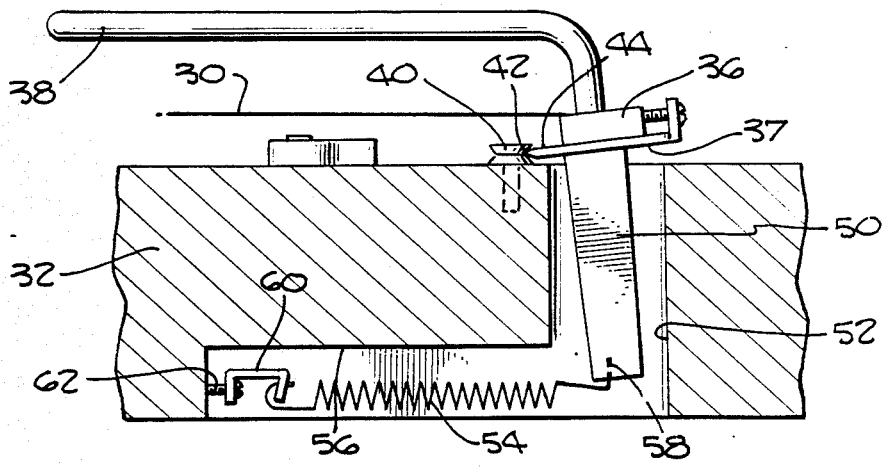
PRIOR ART
Fig. 5.
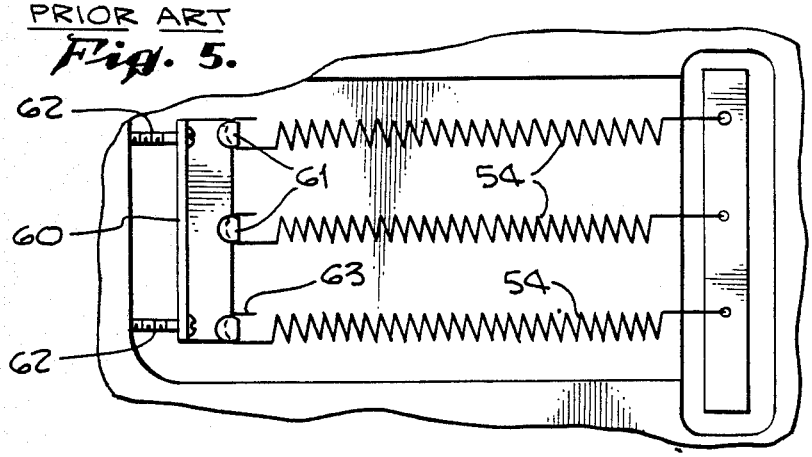

APPARATUS AND METHOD FOR STABILIZING A TREMOLO ON A MUSICAL INSTRUMENT SUCH AS A GUITAR

BACKGROUND OF INVENTION

The present invention relates generally to a method and apparatus for tuning musical instruments having strings such as an electronic guitar. The invention relates to a novel simplified method and apparatus for stabilizing the selected position of a bridge assembly and maintenance of such stabilized position after a tremolo system is activated to vary the pitch of the strings to create novel musical effects.

The invention relates to tremolo control systems. Prior proposed tremolo systems are shown in U.S. Pat. Nos. 4,171,661 and 4,497,236, both issued through Floyd D. Rose. In Pat. No. 4,171,661 a tremolo system is disclosed in which a bridge assembly is provided having a pivotal connection with the guitar body and having means for tuning the guitar strings on the bridge assembly. The bridge assembly includes a spring arm which extends into a cavity in the bottom of the guitar body, the spring arm being connected with one or more tension springs to counter-balance the string tension.

In U.S. Pat. No. 4,497,236, a similar tremolo system is disclosed showing a pivotally mounted bridge assembly having a depending flange connected at its lower end to springs for counter-balancing the string tension. Fine tuning of each of the strings is provided by a fine tuning apparatus connected to the bridge assembly and to the means for securing the end of the string to a system of blocks associated with each guitar string.

The tremolo systems above described require substantial time consuming procedures to precisely tune each guitar string to the desired pitch and to restore that pitch while tuning adjacent strings. Further, the presence and accumulation of dust in the various connections employed in tuning the strings increases the difficulty of fine tuning and also made unreliable the return to a pre-selected neutral tuned condition when the use of the tremolo arm was discontinued. Such prior proposed tremolo systems included the above disadvantages and it is the purpose of the present invention to provide a tremolo system which obviates those disadvantages and provides a tremolo system which may be quickly fine tuned and in which the maintenance of such fine tuning will be retained after the tremolo system is inactivated.

SUMMARY OF INVENTION

The present invention contemplates a novel tremolo system in which fine tuning of a plurality of guitar strings is simplified and wherein maintenance of the pre-tuned selected pitch is retained and positively returned to after actuation of the tremolo system under normal playing conditions.

In a tremolo system, a bridging assembly having a pivotal connection to the guitar body also carries one end of the guitar strings at a suitable nut connection so that the strings are held in selected tension to provide a selected pitch. The bridge assembly provides in effect a connection for each of the strings and the pivotal connection for the bridge assembly to the guitar body permits variation of said tension when a tremolo arm which is connected to the bridge assembly is activated by either increasing the tension of the strings or by reducing the tension of the strings. As in the patents mentioned above, the bridging assembly includes a depending lever arm which extends into a cavity at the bottom face of the guitar body and which is connected to springs which serve to counter-balance the string tension and to position the depending lever arm in a neutral position when the strings are in tuned condition.

The present invention contemplates modifying the counter-balancing spring arrangement of the prior art tremolo control systems by replacing one or more of the counter-balance springs which are normally under tension by a novel stabilizing device which includes a spring means under compression but so arranged as to exert a pulling force on the bridge assembly lever arm. The stabilizer device of this invention includes adjustment means which provides for stabilizing tuning of each of the guitar strings simultaneously through the bridging plate assembly. The stabilizer device also provides positive mechanical stop means for returning the bridge assembly to its neutral position at which the tuned condition of the strings exists.

The primary object of the present invention therefore is to provide and disclose a novel tremolo stabilizer device for an electronic guitar in which fine tuning of the guitar is facilitated and in which return to the preselected tuned condition is made positive after the tremolo arm is released.

An object of the invention is to provide a stabilizer device which may be readily substituted for the counter-balance spring of the tremolo systems of the prior art in order to enhance the operation of such prior musical instruments.

Another object of the invention is to provide a stabilizer device which may be readily constructed and adjusted to retain the desired tuned condition of guitar strings.

A further object of the present invention is to provide a stabilizer device in which counter-balance springs for the tensioned guitar strings are augmented by a system of springs under compression which permit adjustment of a neutral bridging assembly position to be readily accomplished.

A still further object of the invention is to disclose a method of tuning a guitar having a tremolo system in which the guitar strings are tuned to a selected pitch slightly less than the desired pitch and in which the desired pitch may be attained by adjustment of the tremolo stabilizer device of the present invention.

Generally speaking, the present invention provides a tremolo stabilizer device in which the guitar stability will be greatly improved, stability is improved during the fine tuning process, string bending effects, and vibratos are enhanced, other special musical effects are greatly facilitated such as where the player dampens or mutes the strings by gently placing the palm of the right hand in contact with the strings as they intersect the bridge, and the length of time required to change and tune the strings is greatly reduced.

Various other advantages and objects of the present invention will be readily apparent to those skilled in the art from the following description of the drawings in which an exemplary embodiment of the invention is shown.

IN THE DRAWINGS

FIG. 3 is a fragmentary enlarged view of the tremolo arm and bridge assembly shown in FIG. 1.

FIG. 4 is a sectional view taken in a vertical plane indicated by line IV—IV of FIG. 3.

FIG. 5 is a fragmentary enlarged view of a prior art system of counter-balanced springs used with an electric guitar of the type shown in FIG. 1.

DETAILED DESCRIPTION OF INVENTION

Figure 1:
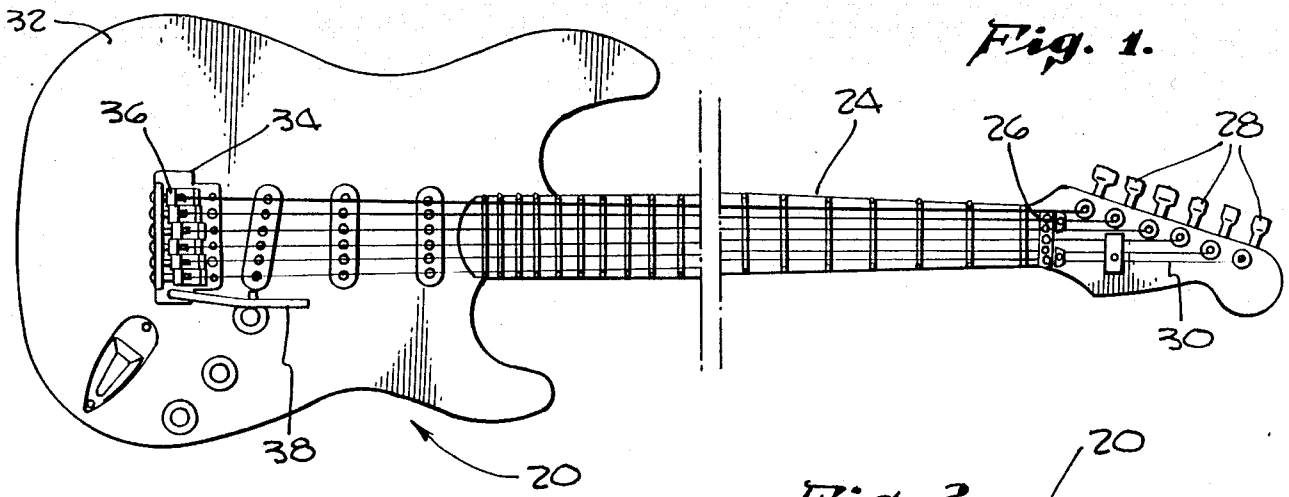
FIG. 1 is a plan view of an electric guitar embodying a tremolo system and embodying the present invention.

In FIGS. 1, 3, 4 and 5, an electric guitar generally indicated at 20 is shown, which includes features known in the prior art (i.e. as shown in U.S. Pat. No. 4,171,661 issued Oct. 23, 1979 to Floyd D. Rose). The counter-balance spring assembly shown in FIG. 2 includes a stabilizer device 22 embodying the present invention and which is used in place of the center counter-balance spring shown in FIG. 5.

The electric guitar 20 generally comprises a neck 24, a nut 26 and a plurality of string tuning pegs 28, each connected to a guitar string 30. Guitar 20 includes a guitar body 32 provided with a tremolo means 34 having a nut end string retaining means 36 for each string 30. The tremolo means 34 includes a base plate 37 having a tremolo arm 38. The body 32 carries on its upper surface spaced anchor screws 40 each providing a V-shaped recess 42 within which is received a knife edge 44 provided on the base plate 37. The base plate 27 opposite the screws 40 is provided with a tapered concavity 46 to partially receive the head of screw 40 and to provide knife edge 44 which is received within the V-shaped recess 42 in order to provide a knife edge type pivotal connection between the base plate 37 and the guitar body 32.

Depending from the base plate 37 is a tremolo lever arm 50 which extends into a transverse recess 52 provided in the guitar body. At the lever arm's 50 lower end, connections are provided for counter-balancing springs 54 which lie within a bottom cavity 56 provided in the bottom face of the guitar body. One end of each counter-balance spring 54 is suitably connected as at 58 to the bottom of lever arm 50. The opposite end of each counter-balance spring 54 is connected to an anchor 60 secured by screws 62 to the guitar body 32. The position of anchor 60 is adjustable by screws 62 to adjust the tension in spring 54.

In the guitar arrangement shown and described above, the strings 30 when tuned to a selected pitch are placed under selected tension and such tension force is counter-balanced by coil springs 54 of selected tension characteristics. When the strings 30 are tuned to a selected pitch and counter-balance springs 54 are adjusted to counter-balance the string tension, the base plate 37 and bridging assembly (plate 37, nut retaining means 36, tremolo arm 38, lever arm 50) assume a neutral position as shown in FIG. 4 with the tremolo lever arm 50 intermediate and spaced from the vertical wall surfaces of recess 52.

In such an arrangement of tuned guitar strings, whose tension is counter-balanced by a set of counter-balance springs 54, when the tremolo arm 38 is moved downwardly toward the body 32 the tension in the guitar strings 30 is reduced and the pitch is also reduced to a desired amount by the guitarist. When the tremolo arm 38 is moved upwardly the tension in strings 30 are increased and the pitch is increased to provide a desired effect by the guitarist. In such movement of the base plate 37 about the knife-edge pivot points in the recesses 42, it will become apparent that the preselected tension and tuning of each of the strings 30 may be changed because of the location of the tremolo arm 38 at one end of the base plate 37, the relatively wide spacing of the screws 40 the change in tension of individual strings because of the presence of dirt, dust, wear or marring of the surfaces of the recesses 42 and knife edges, and wear or breaking down of the guitar body material at screws 40, which provide the pivot mounting for the entire bridging assembly and the distribution of stresses transversely of the base plate 37 may not be uniform. As a result, after using the tremolo arm 38 and selectively increasing and decreasing the pitch of the strings 30, the capability of the counter-balance springs 54 to return the bridging assembly to its neutral pre-tuned condition is diminished and affected with the result that strings 30 do not completely return to their exact previously fine tuned condition.

The stabilizer device 22 of this invention is best shown in FIGS. 6–10 inclusive. In this example of the invention, the stabilizing device 22 is substituted for the central counter-balance spring 54 shown in FIG. 5 and serves to provide positive and reliable means for returning the bridging assembly and tremolo arm to their neutral position and the strings to their pre-tuned pitch after the tremolo arm has been used in normal playing conditions.

In detail, stabilizer device 22 comprises an elongated bracket member 70 having end portions 72 normal to the main portion 71 of the elongated bracket member 70 and providing between end portions 72 a space for receiving a spring means generally indicated at 74. Bracket member 70 adjacent to one of the end portions 72 is pivotally anchored to the guitar body by an anchor member 76 secured in suitable manner as by screws 78 to the guitar body. Anchor 76 is provided with a hook-like end portion 80 which is received within an opening 82 provided in elongated bracket member 70 adjacent to one of the end portions 72. The pivotal movement provided by the hook end portion 80 is limited.

Bracket member 70 at its other end portion 72 is provided with an opening 84 which receives a flanged bushing 86 through which extends a hollow tube 88 having a fixed nut or head 90 adapted to bear as a stop acting in one direction against the flange of bushing 86 at the external or outside face of the adjacent end portion 72. Hollow tube 88 receives therethrough a pull rod 92 which extends through a bushing 94 provided in an aligned opening 96 in the opposite end portion 72 of the bracket member. The pull rod 92 has sufficient length to extend beyond the end portions 72 of the bracket member. At the end of the pull rod adjacent the lever arm 50 of the bridging assembly, the pull rod may be provided with a bent end portion 98 provided with a spherical end 100 received within an outwardly flared recess 101 in the bottom of arm 50 and having bottom spherical surfaces corresponding to spherical end 100 and adapted to permit pivotal movement of the end of the rod 92 relative to the bottom end of the lever arm 50. Thus, stabilizer device 22 of this invention is pivotally connected at one end at 80 to the guitar body 32 and is pivotally anchored through the pull rod at the opposite end to the lower end of lever arm 50 of the bridging assembly.

Spring means are carried by the tube and pull rod between end portions 72 of the bracket member 70. The spring means 74 comprises a main coil spring 102 and a secondary or slack coil spring 104. The main spring 102 is seated at one end over the nipple of the bushing 86 and against the interior surface of end portion 72 of bracket member. At its other end, main spring 102 is seated over a bushing 106 which is seated against a threaded adjustment nut 108 on a threaded portion 110 of tube 88.

Slack spring 104 is ensleeved over the end of tube 88 and at one end is seated against a collar 112 carried by the pull rod 92. Collar 112 acts as a second stop when seated against the end of tube 88 and is secured by a suitable set screw 114 to rod 92 in a selected adjusted position. The opposite end of slack spring 104 is seated as at 116 against the face of adjustment nut 108 which is opposite to the seating of the main spring 102 against the busing 106 and nut 108. The purpose of the slack spring 104 is to expand, when necessary, and maintain the tremolo control device in contact with and against the anchor member 76 at pivot 80 as will be clear from the following description.

The stabilizer device is best explained by reference first to FIG. 7 and 10 in which the lever arm or sustain block 50 of the bridging assembly is shown in neutral or tuned position of the bridging assembly. In such position, each of the strings 30 have been fine tuned and their tension balanced by the counter-balance springs 54 including the stabilizer device so that the bridging assembly is held in neutral tuned position about knife pivots at 42. In bringing the strings 30 to fine tuned position, the guitar strings are tuned to a selected pitch slightly under the normal pitch desired. The stabilizer device 22 is then adjusted by locating and securing collar 112 in a preloaded position on rod 92 with the collar 112 in contact with the end of tube 88. In such preloaded tube contact position collar 112 on rod 92 is a selected distance from the sustain block 50 and provides one stop. Nut 90 on the other end of tube 88 seats against the outer face of bushing 86 and end bracket portion 72 to provide another stop limiting movement of the tube 88 in a direction towards collar 112. Such pre-loaded condition with the two stops in effect at the ends of tube 88 provides the stabilized neutral position of the bridging assembly. With such positioning, each of the strings is affected by this last adjustment of collar 112 of the stabilizer device 22. It may be desirable to check each of the strings and if necessary, fine tune each string by tuning pegs or tuning nuts.

Figure 10:
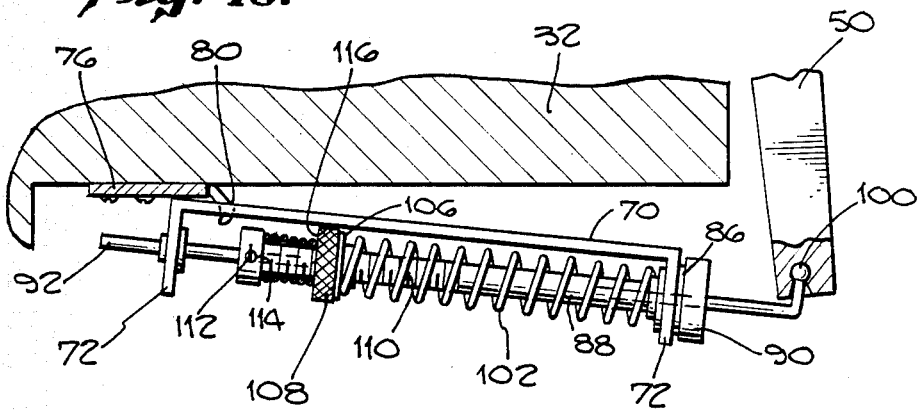
FIG. 10 is a fragmentary sectional view taken in the same plane as FIGS. 8 and 9 showing the stabilizer device in tremolo arm neutral or tuned position of the strings.

As shown in FIG. 10, the pull rod 92 extends through tube 88 and also through the distal end portion 72 of the bracket 70. The collar 112 is adjusted in neutral position to bear against the end face of tube 88 so that the slack spring 104 is under compressed relation between the collar 112 and the adjustment nut 108. It will be apparent that by turning adjustment nut 108, the compression of the main spring 102 may be varied and such variation in compression is transmitted through the end of tube 88 to collar 112 and to the rod 92 which is connected to the bottom of the lever arm 50 so that the lever arm 50 is adjustably movable in one direction or the other depending upon the preload condition desired.

As an example of the forces involved in the tremolo control device in neutral position as described above, reference may be made to FIG. 7 in which the mechanical leverage system of the device is indicated in further detail. In FIG. 7, lever arm 50 in this example has a length of about two inches between the pivot connection 100 of the pull rod to the bottom end of lever arm 50 and the knife edge pivot at 42. The distance between the connection of the strings 30 to the bridging assembly and individual fine tuning nuts 36 is indicated at approximately ½ inch. The point of application of force that a player may exert against the tremolo arm at its distal end and its distance between the knife pivot 42 is indicated at approximately five inches.

Figure 7:
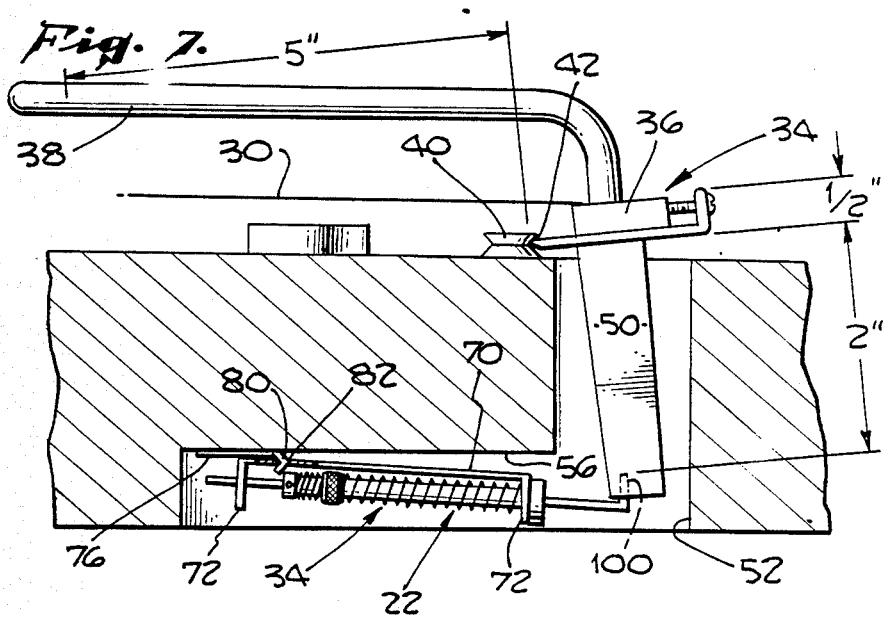
FIG. 7 is a vertical sectional view taken in the same plane as FIG. 4 showing the device of this invention.

When the strings are in tune, there may be a string pull of approximately 100 pounds, pulling the bridge assembly to the left at the string attachment nut 36 or a string pull moving the bottom of the lever arm to the right, FIG. 7, of approximately 25 pounds. The counter springs 54 exert a pull to the left as shown in the drawings of approximately 23 pounds. The main spring 102 of the tremolo control device exerts a force of approximately six pounds against the nut 108 and stop 72 or a total force exerted by the counter springs 54 and the tremolo control device of approximately 29 pounds. The 29 pounds (counter balances springs and main spring 102) minus 25 pounds of the string pull tension equals 4 pounds. The mechanical leverage arrangement provides a 4 to 1 mechanical advantage between the strings and the end of the lever arm 50 which requires a 16 pound gain in pull of the strings 30 to begin to move the tremolo block about its pivot at 42.

Figure 8:
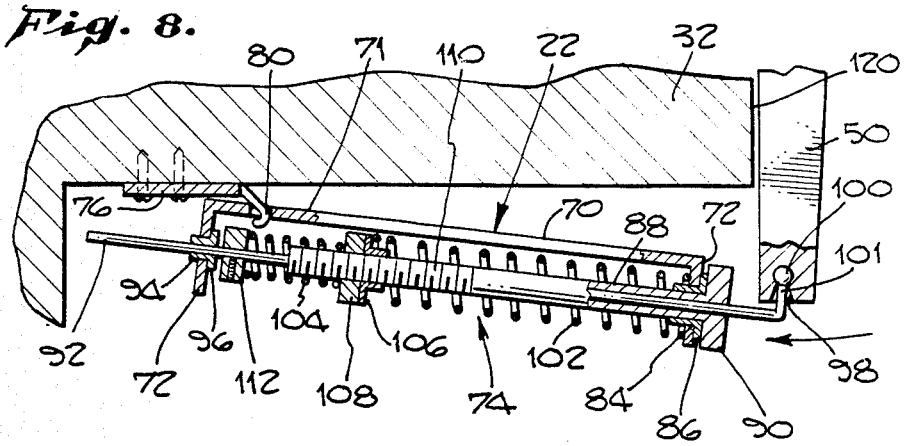
FIG. 8 is an enlarged fragmentary view of the stabilizer device of the present invention showing the action of the device when the tremolo arm is moved to increase the pitch of the strings of the guitar.

In the condition of raising the pitch of the strings by the tremolo arm, the lever arm 50 is indicated in maximum pitch raising position as shown in FIG. 8. In this pitch raising position, it will be noted that the main coil spring 102 is held under its same amount of compression force. The slack spring 104 has expanded in order to maintain the necessary tension to keep bracket 70 in its hinge connection at 80 to the guitar body 32. The pull rod 92 has moved to the left relative to the bracket 70 and to the tube 88 and the lever arm 50 is provided a stop against the wall surface 120 of the guitar body 32.

In such pitch raising mode and considering the computations made above with the mechanical advantage provided by the lever arm, approximately 8/10 of a pound must be exerted on tremolo arm 38 in order to begin to increase the tension of the strings. This is computed as 25 pounds (string pull) minus 23 pounds (counter spring force) which equals 2 pounds which is then divided by 2.5 (mechanical advantage 5″ divided by 2″) is equal 0.8 pounds.

Figure 9:
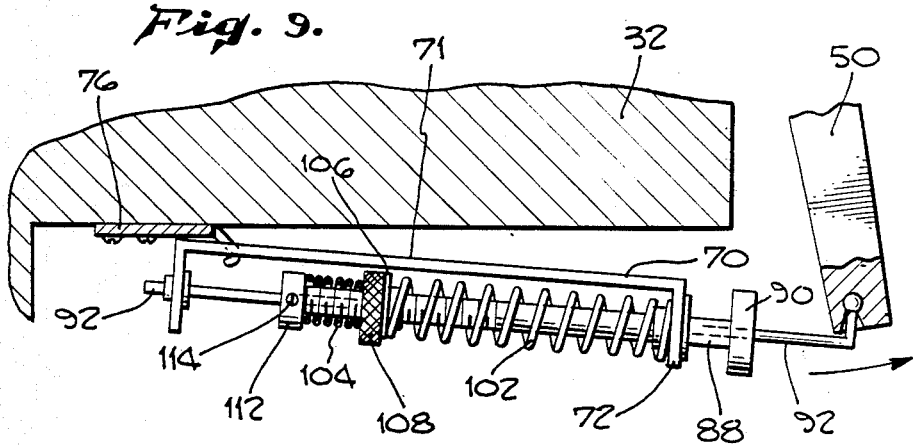
FIG. 9 is a fragmentary sectional view taken in the same plane as FIG. 8 showing the position of the stabilizer device when the tremolo arm is actuated to decrease the pitch of the strings.

In the pitch lowering mode as illustrated in FIG. 9 in which the lever arm 50 is moved to the right from its neutral position as shown in FIG. 10, the pull rod 92 and tube 88 move together relative to member 70 to further compress the main spring 102 between end portion 72 and threaded adjustment nut 108 as shown in FIG. 9. In this example, approximately 1.6 pounds must be exerted downwardly on the tremolo arm 38 to begin to lower the pitch of the strings. Counter-balance springs 54 (23 pounds) plus main spring 102 (6 pounds) equals 29 pounds minus the string pull of 25 pounds equals 4 pounds. Four pounds divided by the mechanical advantage of 2.5 of the tremolo arm is equal to 1.6 pounds.

It should be noted that the stabilizer device 22 is pivotally movable about the pivot connection 100 with respect to the lever arm 50 and is also pivotally movable about the hinge anchor 76 at the hook 80. The slack spring 104 functions to maintain the assembly of the tremolo device 22 with the lever arm 50 and with the guitar body 32. When the tremolo arm is released, the mechanical stops provided by the collar 112 abutting against the end of tube 88 and by nut 90 contacting the outer face of bushing 86 of bracket portion 72 provide position non-variable repositioning of the bridging assembly about its pivot connection at 42 so that the bridging assembly is brought back to its neutral position as desired.

In the prior art counter-balance spring arrangement shown in FIG. 5, it will be noted that the anchor 60 comprises an elongated angle section member which is attached to the guitar body by the two screws 62 located at the ends of the anchor 60. One flange of the angle section is provided with spaced claws or hooks 61, each adapted to receive a bent end 63 of counter-balance tension springs 54. In such prior art anchoring of the counter-balance springs 54, the two screws 62 provide adjustment of the tension of the springs 54 as a group and individual adjustments of the counter-balance tension springs 54 is not provided.

Figure 2:
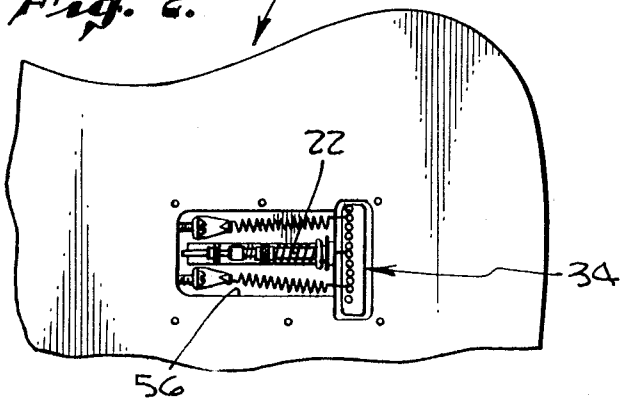
FIG. 2 is a fragmentary bottom view of the guitar shown in FIG. 1 illustrating the stabilizer means of this invention.
Figure 12:
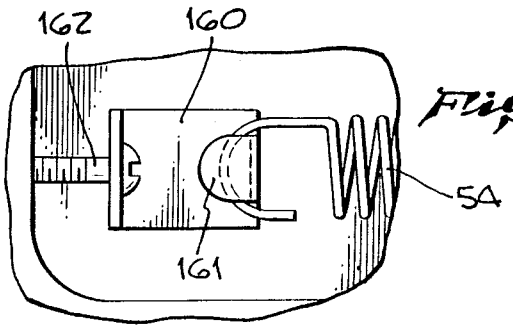
FIG. 12 is a fragmentary bottom view of the guitar body showing a single connecting clip for a single counter-balanced spring in the recess of the bottom of the guitar body.
Figure 6:
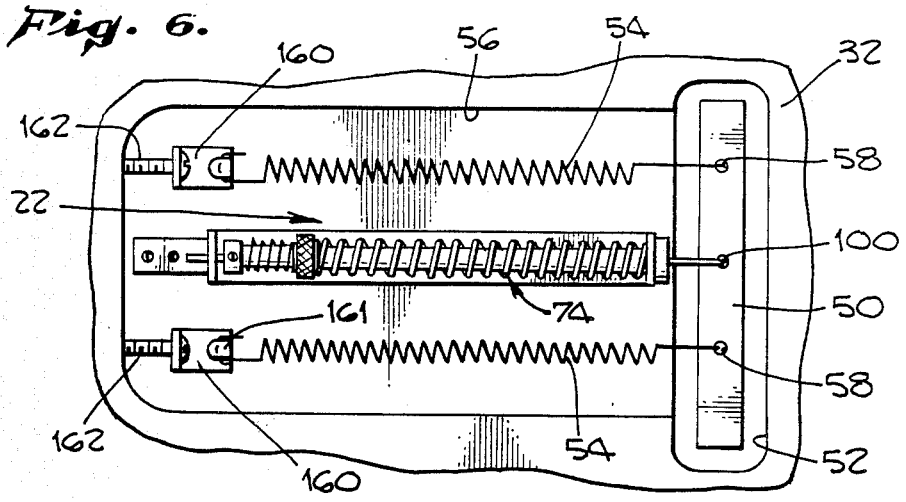
FIG. 6 is an enlarged fragmentary view of the bottom of the guitar showing the device of the present invention.

In the example of the present invention as shown in FIGS. 2, 6, and 12, each counter-balance tension spring 54 is provided with a single adjustable anchor 160 secured to the guitar body by an adjustable screw 162. Each of the anchors 160 is provided with a claw or hook 161 for connection with the bent end of a tension spring 54. Such arrangement of individual anchors for each counter-balance tension spring 54 provides a central space for mounting and installing of the stabilizer device 22 of this invention as described earlier.

Figure 11:
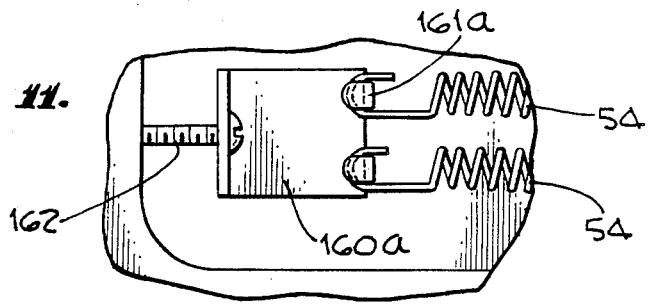
FIG. 11 is a fragmentary bottom view showing a dual counter-balance spring connection to the guitar body.

In FIG. 11, an anchor 160*a* is connected to the guitar body by an adjustment screw 162, anchor 160*a* being provided with a pair of hooks or claws 161*a* for connection to a pair of adjacent counter-balance tension springs 54. Such a dual anchor may be desirable in certain guitar counter-balance spring installations.

As shown in FIG. 6, two single anchors 160 for two counter-balance springs 54 are provided for individual adjustment of tension of each of the springs 54. Adjustment of springs 54 serves to position the lever arm 50 or sustain block in a desired selected neutral position in the recess 52 provided in the guitar body and under a condition in which the guitar strings 30 are in tuned condition.

It will be apparent to those skilled in the art that the stabilizer device of the present invention automatically centers the tremolo bridge assembly and sustain block in a neutral pitch position. The musician pushes the tremolo arm towards the base of a guitar to lower the pitch of the strings or when he pulls the tremolo arm away from the base of the guitar, raises the pitch of the string. When the musician releases the tremolo arm, the stabilizer device will automatically return the bridge assembly and the sustain block or lever arm, by means of the mechanical stops described above, to its precise original neutral position. Under normal playing conditions, the strings, therefore, will return to their exact preset original pitch. The prior art system of relying solely on counter-balance springs to balance against the tension of the strings is not sufficiently accurate and is too sensitive to conditions of wear and friction at the knife edge pivot. Also, the bridge assembly is not held stable in neutral position and may move at the slightest touch or sag at the slightest increase in string tension.

When the musician pushes down on the tremolo arm towards the face of the guitar, the entire bridge assembly is pivoted about pivot points 42 and the lever arm or sustain block 50 pivots backwardly (as in FIG. 9) with the bridge assembly. Such movement causes pull rod 92, collar 112, and tube 88 to further compress the compression spring 102 of the main spring 102. The entire stabilizer device pivots about anchor 76 at pivot 80 as it follows the arc of the lever arm 50. When the musician releases the tremolo arm 38, the counter-balance springs 54 and the compression spring 102 causes the return of the bridging assembly and sustain block 50 to neutral position where the bridge assembly is centered with the tension in the guitar strings at the selected pre-tuned condition.

When the musician pulls the tremolo arm 38 upwardly, the guitar strings are stretched and their pitch is raised. The lever arm 50 or sustain block moves forward about the pivots 42 and pushes with it the pull rod 92. Collar 112 moves away from the end of tube 88 (as in FIG. 8) and the slack spring 104 expands but continues to maintain slight pressure on the tremolo control device to keep it nestled or seated against the anchor 76. Slack spring 104 does not contribute to the function of the tremolo device in any other way as its spring force is negligible. The compression spring 102 held in position by the adjustment nut 108 and the end portion 72 of the bracket member also does not contribute to the tremolo function in the pitch raising mode. The guitar strings are entirely counter-balanced in this mode of operation by only the counter-balance springs 54. When the tremolo arm is released, the tension of the strings pulls the bridging assembly back into neutral position and the pull rod is pulled by the lever arm 50 so as to bring the collar 112 to bear or seat on the end of the tube 88 and thereby provide an accurate mechanical stop for returning the tremolo device to its precise original position and thus the guitar strings to their original selected pitch.

Once the tremolo stabilizing device has been adjusted and set in final tuned condition of the strings, the adjustment need not be changed. Replacement of a string may be made without requiring further adjustment of the stabilizer device; the bridge assembly will be returned to its neutral position upon tuning of the replaced string.

It will thus be apparent to those skilled in the art that the stabilizer device of this invention is capable of functioning for uses of the guitar which include string bending, vibratos, muting, and tuning. By relative rotation of the adjustment nuts 108 and 90 on tube 88, the compression of the compression spring 102 may be increased so that more force will be required to move the tremolo bridge assembly into a pitch lowering mode. With proper adjustment of the adjustment nuts 108 and 90, the force exerted during string bending, vibratos, palm contact with the bridge assembly, etc. can be virtually neutralized by the compression spring 102 and stability of the bridge assembly and tremolo system is thereby greatly increased.

Various modifications and changes may be made in the exemplary tremolo control device described above and all such changed and modifications coming within the spirit of the invention and within the scope of the appended claims are embraced thereby.

We claim:

1. A stabilizer device for use with a tremolo on a guitar having a bridge assembly with a sustain lever arm, comprising in combination:

an elongated bracket member adapted to provide a pivotal connection at one end to a guitar body;

a pull rod carried by said bracket member, movable relative thereto, and adapted to be connected at one end to the bridge assembly lever arm;

said bracket member providing a first stop adjacent to said one end of said pull rod;

a tube sleeved over said pull rod and having a tube nut at one end cooperable with said first stop in one position of the lever arm;

an adjustable collar fixed to said pull rod adjacent the other end of said tube and adapted to abut said other end of the tube to provide a second stop at a selected adjustable distance from the lever arm;

and a main spring means on said tube biasing said tube nut against said first stop;

whereby said first and second stops determine a neutral position of said lever arm.

2. A device as claimed in claim 1 including an adjustment nut on said tube for adjustably biasing said main spring means.

3. A device as claimed in claim 2 including a slack spring extending between said adjustment nut on said tube and said collar on said pull rod.

4. In an electric guitar having a pivoted bridge assembly connected to a tremolo arm including:

stabilizer means for precisely locating said bridge assembly during non-use of said tremolo arm, and comprising an elongated bracket member having a bracket end portions;

means providing a pivotal connection between said bracket member and said guitar;

a pull rod extending through said bracket end portions and having an end distal from said pivotal connection to said guitar and pivotally connected to said bridge assembly;

a tube sleeved over said pull rod, one end of said tube having an end head adapted to seat against said adjacent bracket end portion to serve as one stop;

the other end of said tube being spaced from the other bracket end portion; an adjustable collar carried by said pull rod between said last mentioned bracket end portion and the adjacent end of said tube and adapted to abut said adjacent end of said tube to serve as a second stop;

an adjustment nut threaded on said tube;

a main spring means sleeved over said tube between said adjustment nut and said bracket end portion serving as said one stop;

a second spring means between said adjustment nut and said adjustable collar on said pull rod, said collar on the pull rod being set to a selected distance from said pivotal connection of said rod to said bridge assembly to position the bridge assembly at a selected neutral position when the adjustable collar abuts the adjacent end of the tube and said head on said tube is in abutment with the bracket end portion serving as said one stop;

said adjustment nut providing a selected compressive spring force in said main spring means and serving to preload said stabilizer device to positively return said bridge assembly to its neutral position after actuation and release of the tremolo arm.

5. In an electric guitar as claimed in claim 4, wherein movement of the tremolo arm to lower the pitch of the strings causes movement of said tube and said pull rod relative to the bracket member to further compress said main spring means between said nut and said bracket end portion.

6. In an electric guitar as claimed in claim 4 wherein movement of the tremolo arm to increase the pitch of the guitar strings decreases compression of the slack spring between said nut and said collar and without changing compression of the main spring.

7. In an electric guitar as claimed in claim 6 wherein said decrease of compression of said slack spring includes movement of said pull rod relative to said tube and spacing of said stop collar from the end of said tube and expansion of said slack spring to maintain said pivotal connection of said member to said guitar.

8. In an electric guitar having a plurality of strings, means for tuning said strings, a tremolo system including a pivoted bridge assembly including a tremolo arm, and a plurality of tremolo counter-balance springs connected with said pivoted bridge assembly;

the combination of an improvement comprising:

a tremolo stabilizer device including:

a bracket adapted to be connected to said guitar and having one end portion adjacent to said guitar, the other end portion of said bracket being adjacent to said bridge assembly;

a pull rod supported by said end portions of said bracket and having one end connected with said bridge assembly;

a tube in the space between said bracket end portions, said tube being extendable through said end portion adjacent to said bridge assembly;

said pull rod extending through said tube;

a collar at one tube end adjustably fixed to said rod;

a stop nut on the other end of said tube outside said other end portion;

an adjustment nut intermediate ends of the tube and threaded on said tube;

a first compression spring between said last mentioned adjustment nut and said other end portion;

a second compression slack spring between said adjustment nut and said collar;

whereby selected adjustment of said collar on said rod provides the return of said bridge assembly to a selected neutral position.

* * * * *